US010513834B2

(12) United States Patent
Amrein et al.

(10) Patent No.: US 10,513,834 B2
(45) Date of Patent: Dec. 24, 2019

(54) MODULAR BLOCK RETAINING WALL CONSTRUCTION SYSTEM WITH CHANNELS AND METHODS OF MANUFACTURE AND USE

(71) Applicants: John T. Amrein, Shawnee, KS (US); Darren O'Rourke, Shawnee, KS (US)

(72) Inventors: John T. Amrein, Shawnee, KS (US); Darren O'Rourke, Shawnee, KS (US)

( * ) Notice: Subject to any disclaimer, the term of this patent is extended or adjusted under 35 U.S.C. 154(b) by 0 days.

(21) Appl. No.: 15/887,714

(22) Filed: Feb. 2, 2018

(65) Prior Publication Data

US 2018/0274196 A1 Sep. 27, 2018

Related U.S. Application Data

(63) Continuation-in-part of application No. 15/466,537, filed on Mar. 22, 2017.

(51) Int. Cl.
*E02D 29/02* (2006.01)

(52) U.S. Cl.
CPC ..... *E02D 29/025* (2013.01); *E02D 29/0225* (2013.01)

(58) Field of Classification Search
CPC ..... E02D 29/025; E02D 29/0233; E02D 29/0225; E02D 29/0241; E04C 1/395; E04C 1/00
USPC ..... 405/284, 286; 52/592.6, 603, 604
See application file for complete search history.

(56) References Cited

U.S. PATENT DOCUMENTS 2,390,929 A 12/1945 Ellis
4,448,571 A 5/1984 Eckels
5,154,542 A * 10/1992 Klenert ..... E02D 17/18 405/284
5,474,405 A 12/1995 Anderson et al.
5,499,891 A * 3/1996 Klenert ..... E02D 29/025 405/262
5,533,839 A 7/1996 Shimada
5,564,865 A * 10/1996 Jansson ..... E02D 29/025 405/284

(Continued)

FOREIGN PATENT DOCUMENTS

DE 2604881 * 8/1977
JP 05321265 * 12/1993
JP D1529488 7/2015

*Primary Examiner* — Carib A Oquendo

(74) *Attorney, Agent, or Firm* — Polsinelli PC; Adam C. Rehm

(57) ABSTRACT

A modular block retaining wall construction system with a plurality of blocks. Each of the plurality of blocks include (i) a front wall defining a face surface, (ii) a pair of exterior sidewalls extending from the front wall, (iii) an exterior rear wall extending partially between the pair of exterior sidewalls, (iv) an interior rear wall extending partially between the pair of exterior sidewalls and spaced between the front surface and the exterior rear wall, (v) a pair of interior sidewalls extending between the exterior rear wall and the interior rear wall, and (vi) a divider extending from the interior rear wall, extending between the pair of interior sidewalls, and partially defining a plurality of channels. In this manner, each channel can be filled with a predetermined amount of material, e.g., gravel, to facilitating proper drainage of liquid, e.g., water, from the soil and/or other material retained by the retaining wall of the present inventive concept.

15 Claims, 11 Drawing Sheets

(56) References Cited

U.S. PATENT DOCUMENTS

| | | | | |
|---|---|---|---|---|
| 5,921,715 | A | 7/1999 | Rainey | |
| D421,896 | S | 3/2000 | Hamernik | |
| D422,092 | S | 3/2000 | Perkins | |
| 6,168,351 | B1 | 1/2001 | Lagman | |
| 6,168,354 | B1 * | 1/2001 | Martin | E02D 29/025 405/284 |
| 6,416,260 | B1 * | 7/2002 | Khamis | E02D 29/0241 405/262 |
| 6,464,432 | B1 * | 10/2002 | Shaw | E02D 29/0241 405/284 |
| D479,343 | S | 9/2003 | Wagg | |
| D625,028 | S | 10/2010 | Bott | |
| D636,897 | S | 4/2011 | Bott | |
| 8,136,325 | B1 | 3/2012 | Van Lerberg et al. | |
| D732,699 | S | 6/2015 | Von Handorf | |
| D764,897 | S | 8/2016 | Partridge | |
| 2003/0037505 | A1 | 2/2003 | Schulze | |
| 2003/0070385 | A1 | 4/2003 | Bott | |
| 2006/0051166 | A1 * | 3/2006 | Lee | E02D 29/0233 405/284 |
| 2009/0041552 | A1 | 2/2009 | Hammer | |
| 2012/0063853 | A1 | 3/2012 | Bott | |
| 2013/0022403 | A1 | 1/2013 | Freitag et al. | |
| 2014/0102028 | A1 | 4/2014 | Bethlendy, Jr. | |
| 2014/0260038 | A1 | 9/2014 | Giarritta | |
| 2015/0071715 | A1 | 3/2015 | Hammer et al. | |
| 2015/0159339 | A1 | 6/2015 | Castonguay et al. | |
| 2016/0130780 | A1 | 5/2016 | Castonguay et al. | |
| 2017/0284052 | A1 * | 10/2017 | McIntosh | E02D 5/24 |
| 2018/0010337 | A1 | 1/2018 | Giarritta | |

* cited by examiner

MODULAR BLOCK RETAINING WALL CONSTRUCTION SYSTEM WITH CHANNELS AND METHODS OF MANUFACTURE AND USE

CROSS-REFERENCE TO RELATED APPLICATIONS

The present application is a continuation-in-part of U.S. patent application Ser. No. 15/466,537, entitled "Modular Block Retaining Wall Construction System with Spacer Plates and Methods of Manufacture and Use" and filed on Mar. 22, 2017. U.S. patent application Ser. No. 15/466,537 is incorporated by reference herein in its entirety.

BACKGROUND OF THE INVENTION

1. Field of the Invention.

The present inventive concept relates generally to a wall construction system, and more particularly, to a retaining wall construction system with a plurality of modular blocks and a plurality of channels, and methods of use and manufacture.

2. Description of the Related Art.

Conventional systems and methods for constructing retaining walls suffer from various inefficiencies. Among others, use of conventional methods results in excessive wasted materials and presents a dangerous condition during construction. For instance, it is generally desirable to include draining means, e.g., gravel, on a side of the wall that functions to retain soil and/or other material, thereby facilitating proper drainage of water from the soil and/or other material. When using gravel, the wall is constructed and backfilled with an amount of gravel believed to be sufficient, which often results in use of an excess amount of gravel. Further, prior to being backfilled, a large gap or hole is formed between the wall and the soil and/or other material. Until the hole is filled with gravel and/or soil, people and/or animals may accidentally fall into and become trapped in the hole.

Accordingly, there is a need for a retaining wall construction system with methods of use and manufacture that does not suffer from the limitations of conventional system and methods for constructing walls, prevents waste of materials, does not present any dangerous conditions during construction, has a simple design that is easy to use, and has reproducible methods for manufacture and use.

SUMMARY OF THE INVENTION

The following brief description is provided to indicate the nature of the subject matter disclosed herein. While certain aspects of the present inventive concept are described below, the summary is not intended to limit the scope of the present inventive concept. Embodiments of the present inventive concept provide an inventive concept for a retaining wall construction system, and a method of manufacturing and using such retaining wall construction system. The present inventive concept does not suffer from and remedies the deficiencies of conventional systems and methods such as those previously set forth herein.

The present inventive concept provides, in its simplest form, a modular block. The modular block may include a front wall defining a face surface and/or a pair of exterior sidewalls extending from the front wall. The face surface may be a contoured surface. The front wall may have a front wall length (Length_FW) and each of the pair of exterior sidewalls may have an exterior side wall length (Length_ESW). A ratio Length_FW:Length_ESW may be at least 1.5:1. Length_FW may be in the range of 40-56 inches. Length_ESW may be in the range of 20-28 inches. The modular block may also include an exterior rear wall extending partially between the pair of exterior sidewalls. The modular block may also include an interior rear wall extending partially between the pair of exterior sidewalls and spaced between the front wall and the exterior rear wall. The modular block may also include a pair of interior sidewalls extending between the exterior rear wall and the interior rear wall. The pair of interior sidewalls and the interior rear wall may define at least one channel.

The modular block may further include a divider. The divider may extend from the interior rear wall and may extend between the pair of interior sidewalls. The divider may also partially define a plurality of channels. Each of the plurality of channels may include a top, bottom, and/or rear openings. The modular block may further include an anchor extending into the divider. The modular block may further include a strap extending from the anchor and operable to hold the modular block in a soil mass. The modular block may further include a filter. The filter may extend at least partially across the exterior rear wall and may be operable to permit liquid to pass therethrough. The modular block may further include a protrusion. The protrusion may extend from the exterior rear wall and may define a first abutment surface. The modular block may further include an indentation. The indentation may extend into the rear wall and may define a second abutment surface. The indentation and the protrusion may have corresponding sized and shaped. The indentation may be configured to receive at least a portion of another protrusion of another modular block when the another modular block is stacked on the modular block so that the second abutment surface at least partially receives another first abutment surface of another modular block.

The present inventive concept further provides a method of manufacturing the retaining wall system, and a method of using or forming a retaining wall using the retaining wall system. The aforementioned objects and advantages of the present inventive concept may be achieved by providing a method of manufacturing a modular block. The method may include the step of forming a block including (i) a front wall defining a face surface, (ii) a pair of exterior sidewalls extending from the front wall, (iii) an exterior rear wall extending partially between the pair of exterior sidewalls, (iv) an interior rear wall extending partially between the pair of exterior sidewalls and spaced between the front wall and the exterior rear wall, (v) a pair of interior sidewalls extending between the exterior rear wall and the interior rear wall, and (vi) a divider extending from the interior rear wall, extending between the pair of interior sidewalls, and partially defining a plurality of channels. The method may further include the step of securing a filter to the exterior rear wall, the filter operable to at least partially enclose the plurality of channels. The method may further include the step of securing an anchor within the divider so that a hook of the anchor is exposed. The method may further include the step of forming a protrusion extending from the exterior rear wall. The method may further include the step of forming an indentation in the exterior rear wall. The protrusion and the indentation may be correspondingly sized and shaped.

An object of the present inventive concept is to provide a modular retaining wall system and methods operable to accommodate various applications and design specifications, thereby allowing the system and methods of the present inventive concept to be utilized in any instance where a retaining wall is desired. The aforementioned objects and advantages of the present inventive concept may be achieved by providing a method of forming a retaining wall using a plurality of modular blocks. The method may include the step of forming a first portion by placing a first set of modular blocks along a first row, each of the modular blocks having (i) a front wall defining a face surface, (ii) a pair of exterior sidewalls extending from the front wall, (iii) an exterior rear wall extending partially between the pair of exterior sidewalls, (iv) an interior rear wall extending partially between the pair of exterior sidewalls and spaced between the front wall and the exterior rear wall, and (v) a pair of interior sidewalls extending between the exterior rear wall and the interior rear wall defining at least one channel. Each of the plurality of modular blocks may further include an indentation extending on first edge. Each of the plurality of modular blocks may further include a protrusion extending on a second edge opposite and mirrored to the first edge. Each of the plurality of modular blocks may be operable to be stacked on top of each other by way of the indentation receiving the protrusion. The method may also include the step of filling a first space defined by each channel of the first set of the modular blocks. The method may also include the step of forming a second portion by placing a second set of the modular blocks along a second row. The method may also include the step of filling a second space defined by each channel of the second set of modular blocks. Each of the first space and the second space may have a predetermined volume.

Another object of the present inventive concept is to provide a modular retaining wall system and methods that does not present any dangerous conditions during construction thereof.

Another object of the present inventive concept is to provide a modular retaining wall system and methods operable to comply with retaining wall best practices and/or applicable regulations regarding retaining walls and proper drainage requirements.

The foregoing and other objects are intended to be illustrative of the present inventive concept and are not meant in a limiting sense. Many possible embodiments of the present inventive concept may be made and will be readily evident upon a study of the following specification and accompanying drawings comprising a part thereof. Various features and subcombinations of the present inventive concept may be employed without reference to other features and subcombinations. Other objects and advantages of this present inventive concept will become apparent from the following description taken in connection with the accompanying drawings, which set forth by way of illustration and example, an embodiment of this present inventive concept and various features thereof.

BRIEF DESCRIPTION OF THE DRAWINGS

A preferred embodiment of the present inventive concept, illustrative of the best mode in which the applicant has contemplated applying the principles, is set forth in the following description and is shown in the drawings.

DETAILED DESCRIPTION OF THE PREFERRED EMBODIMENTS

Figure 1:
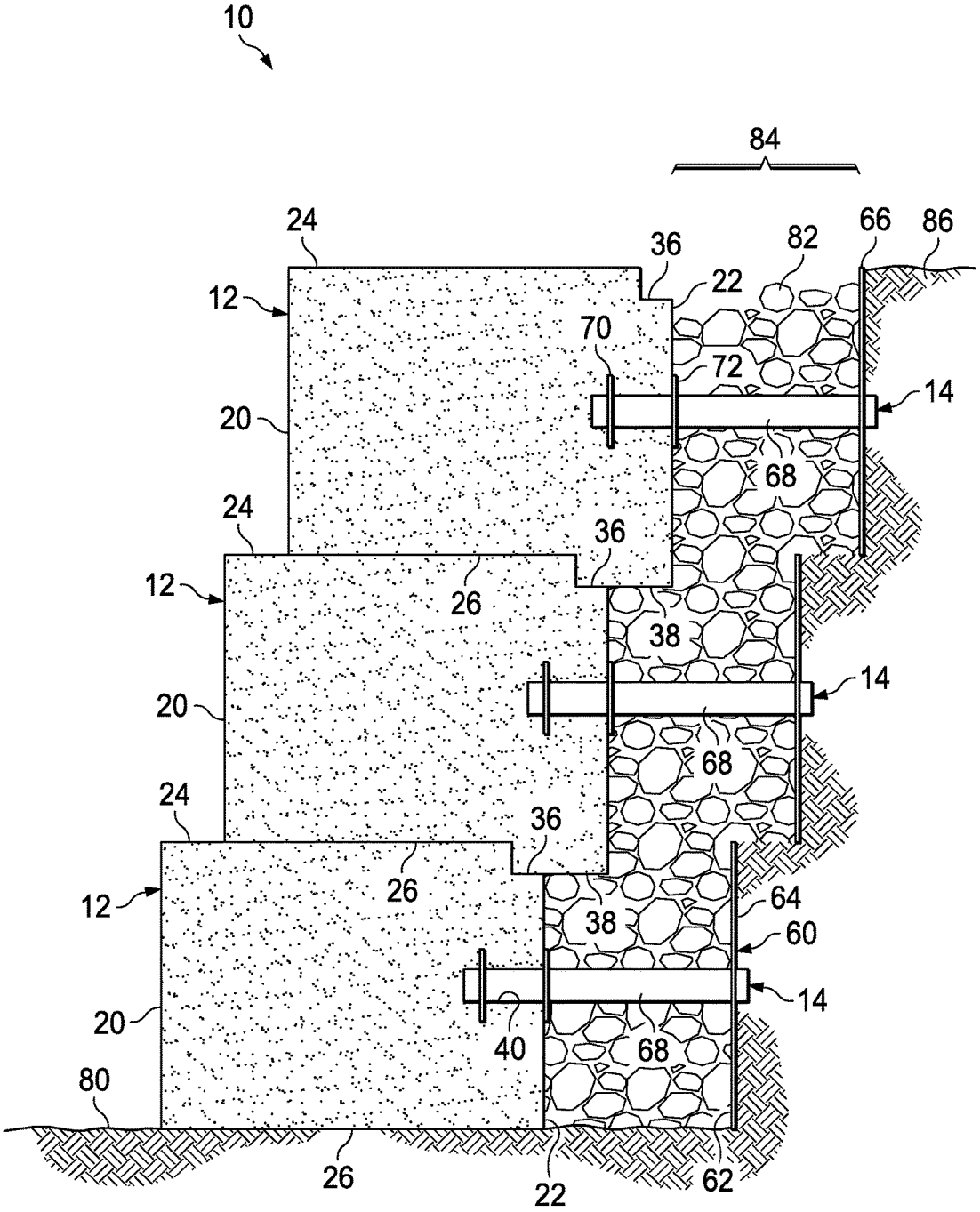
FIG. 1 is a left side elevation, cross-section view of a modular block wall construction system of the present inventive concept assembled and in use.
Figure 2:
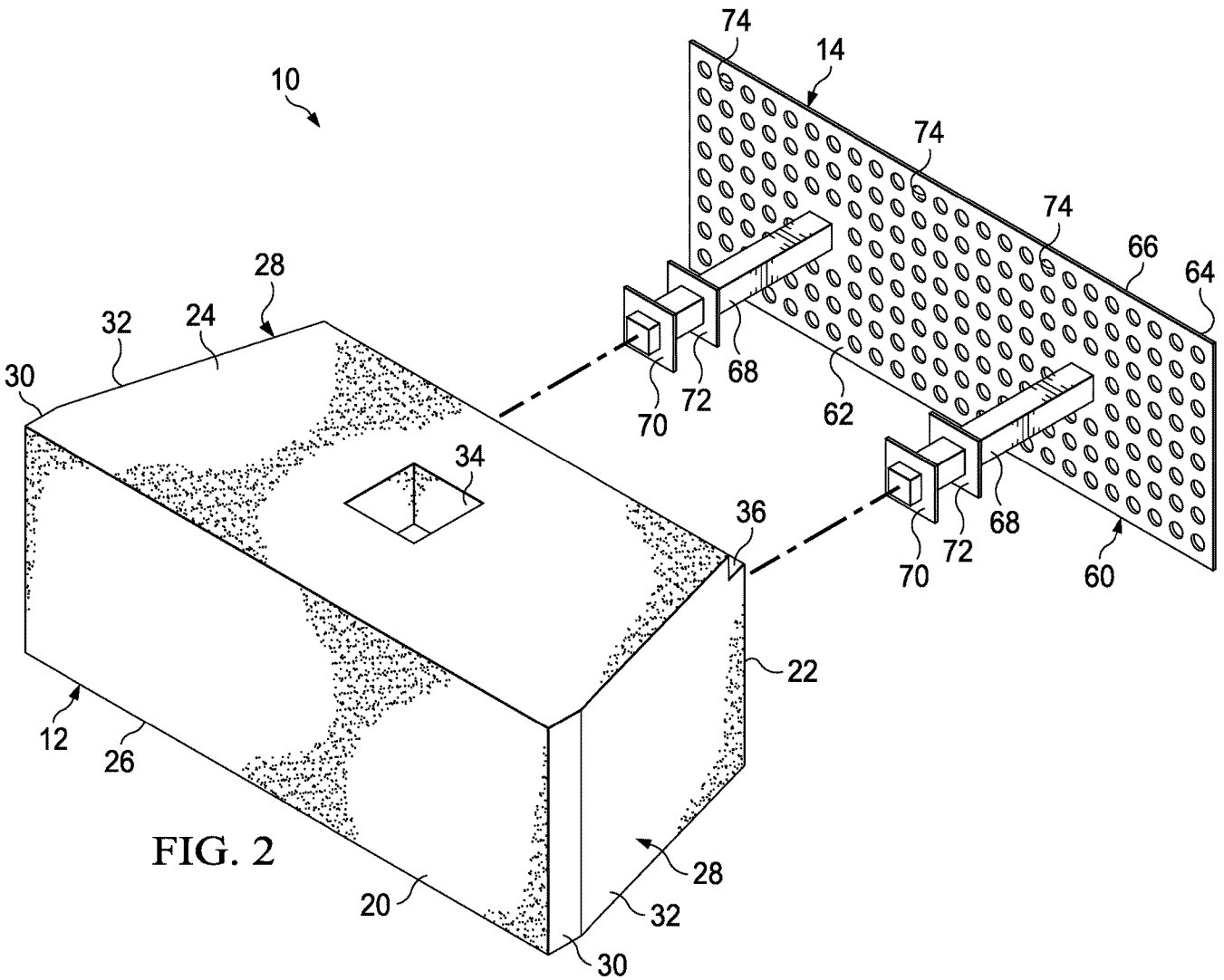
FIG. 2 is an exploded, perspective view of a modular block and a spacer plate of the system of FIG. 1, with the modular block and the spacer plate unassembled and prior to use.
Figure 3:
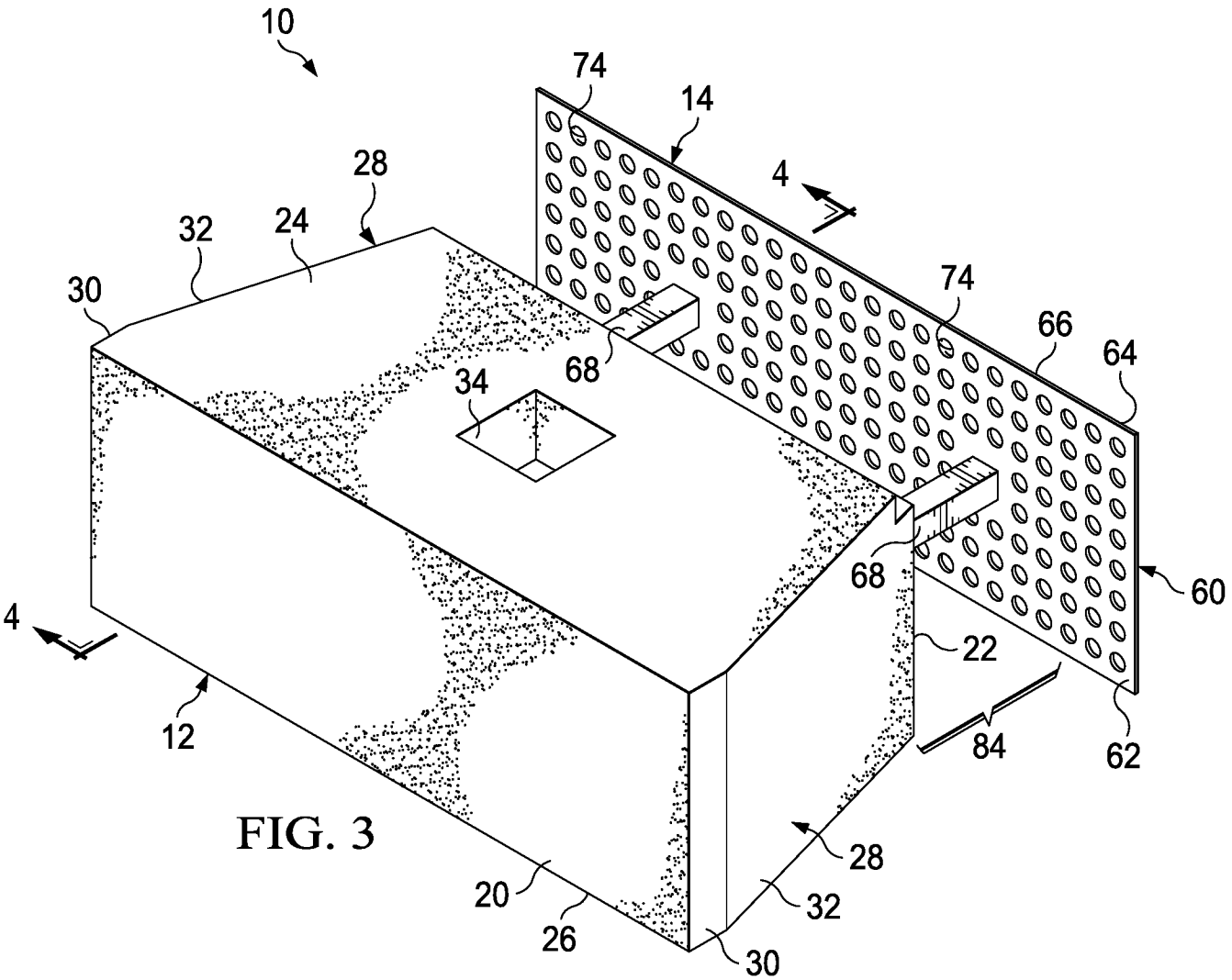
FIG. 3 is a perspective view of the modular block and the spacer plate of FIG. 2, with the modular block and the spacer plate assembled to define a cavity therebetween and prior to use.
Figure 4:
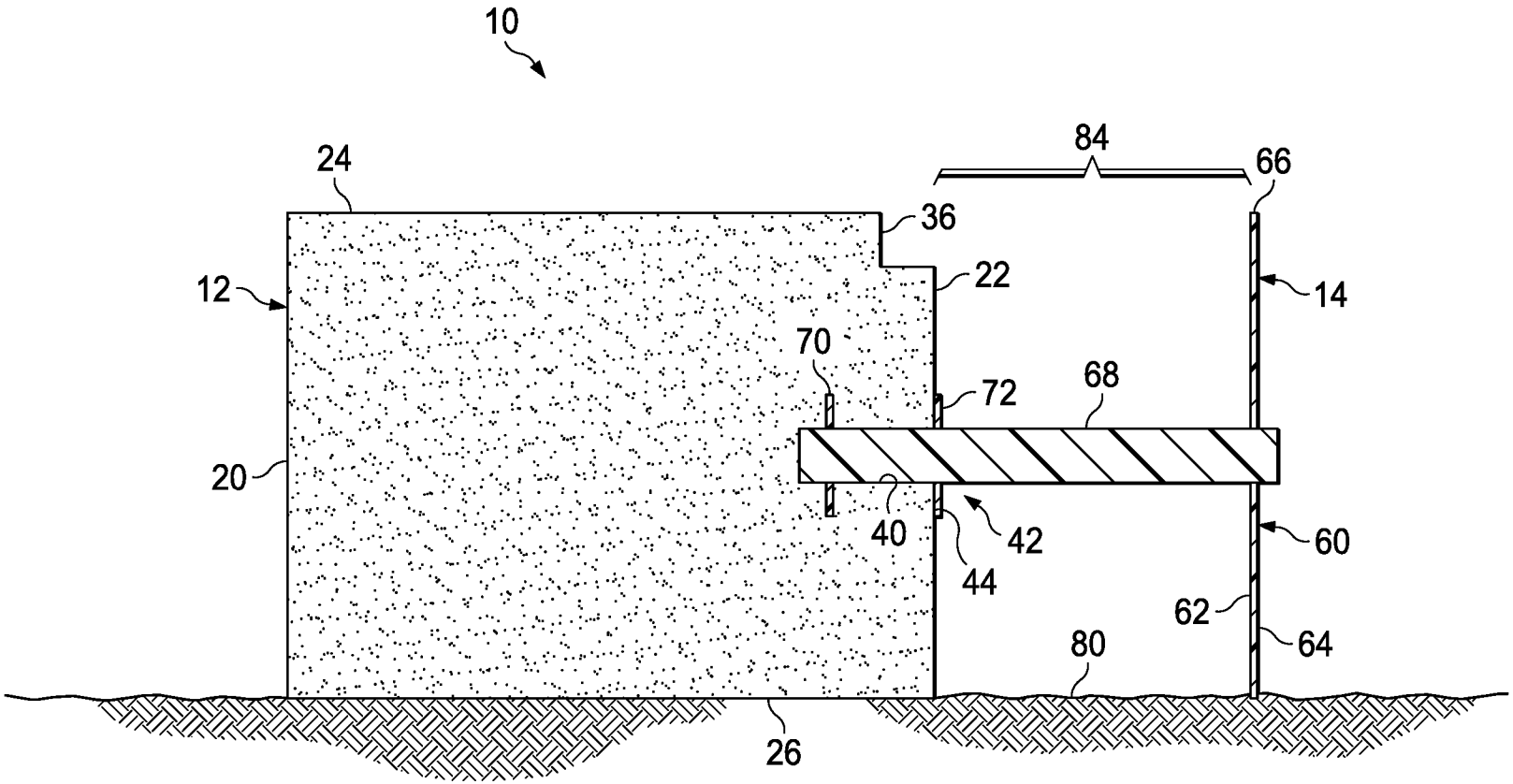
FIG. 4 is a left side elevation, cross-section view of the modular block and the spacer plate of FIG. 3 taken along 4-4, with the modular black and the spacer plate installed on a ground surface and prior to filling of the cavity.
Figure 5:
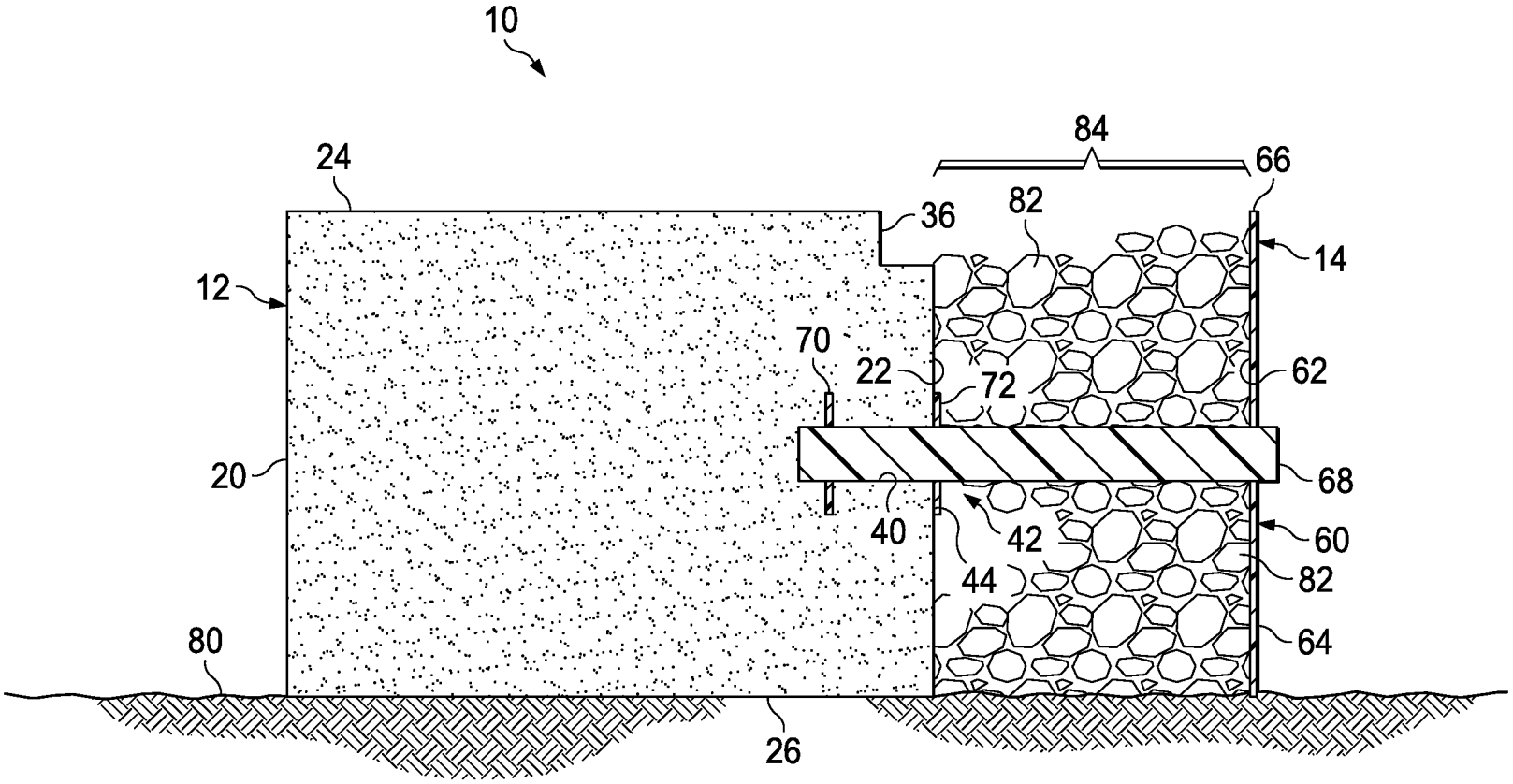
FIG. 5 is a left side elevation, cross-section view of the modular block and the spacer plate of FIG. 4, after filling of the cavity.
Figure 6:
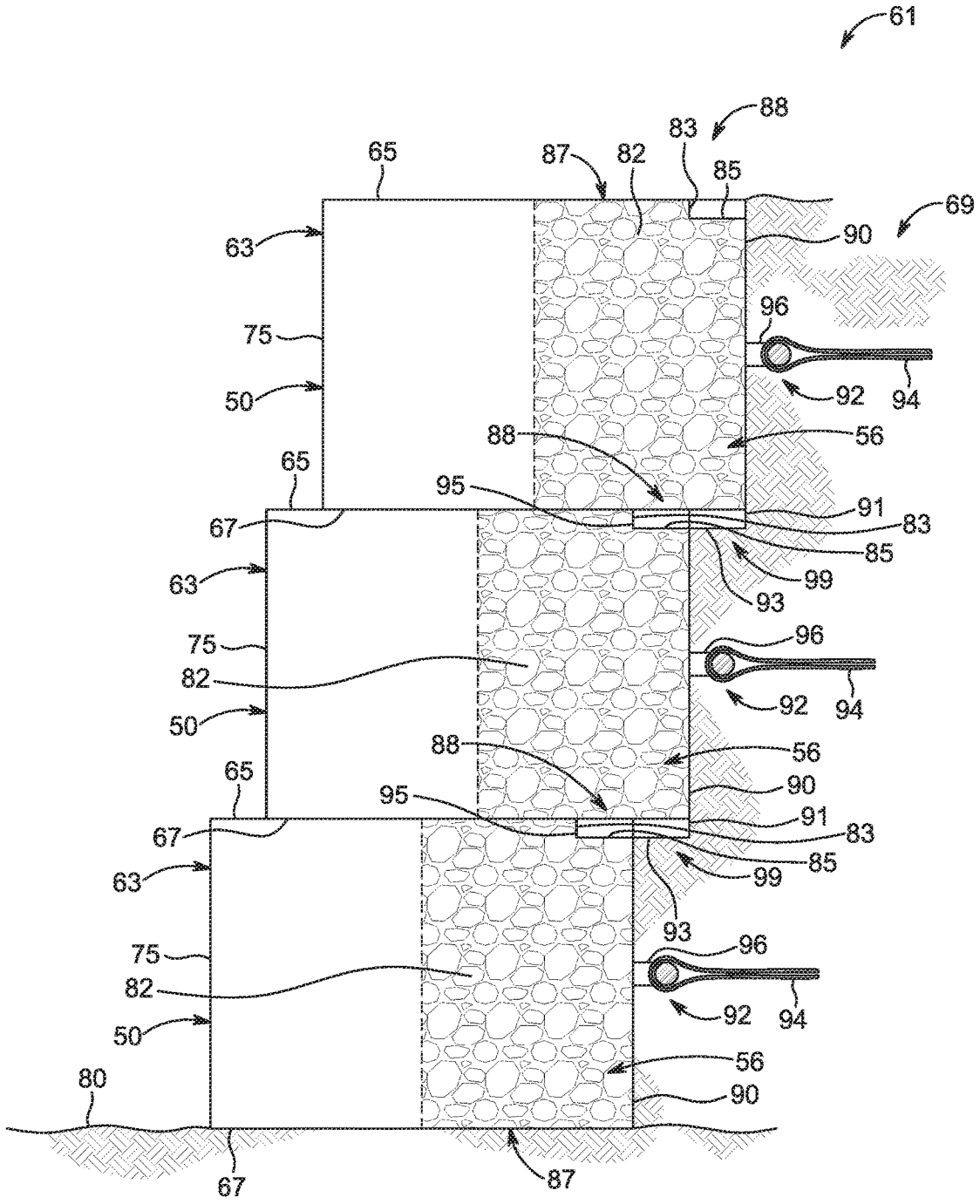
FIG. 6 is a left side elevation, cross-section view of a modular block wall construction system according to another embodiment of the present inventive concept assembled and in use.

The following detailed description of the present inventive concept references the accompanying drawings that illustrate specific embodiments in which the present inventive concept can be practiced. The embodiments are intended to describe aspects of the present inventive concept in sufficient detail to enable those skilled in the art to practice the present inventive concept. Other embodiments can be utilized and changes can be made without departing from the scope of the present inventive concept. The following detailed description is, therefore, not to be taken in a limiting sense. The scope of the present inventive concept is defined only by the appended claims, along with the full scope of equivalents to which such claims are entitled.

In this description, references to "one embodiment," "an embodiment," or "embodiments," mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, or the like described in one embodiment may also be included in other embodiments, but is not necessarily included. Thus, the present technology can include a variety of combinations and/or integrations of the embodiments described herein. The use of relational terms such as, but not limited to, "front," "rear," "underside," "upperside," "top," "bottom," "left," "right," "upper," "lower," "down," "downward," "up," "upward," and "side," are used in the description for clarity in specific reference to the figures and are not intended to limit the scope of the present inventive concept or the appended claims.

Turning to the drawings and particularly FIGS. 1-5, a retaining wall system 10 is illustrated. The system 10 includes a plurality of modular blocks 12 and a plurality of spacer plates 14. Each of the plurality of spacer plates 14 is operable to be securely fastened to one of the plurality of blocks 12.

Each of the plurality of blocks 12 including a front surface 20, a rear surface 22 extending parallel to the front surface 20, a top surface 24, a bottom surface 26 extending parallel to the top surface 24, and side surfaces 28 with parallel portions 30 that extend parallel to each other and diverging portions 32 that extend toward each other along divergent planes.

An entirety of the front surface 20 or only a portion of the front surface 20 may include surface ornamentation such as, but not limited to a textured surface, a smooth surface, and/or one or more depictions or designs, thereby advantageously providing an improved aesthetic appearance of the plurality of blocks 12. In the exemplary embodiment, the front surface 20 is planar, with a width of 48 inches and a height of 18 inches, but it is foreseen that the front surface 20 may be otherwise sized and/or shaped without deviating from the scope of the present inventive concept.

The top surface 24 of each of the plurality of blocks 12 includes a cavity 34 operable to receive an element therein, which may be utilized for, among other things, anchoring an adjacent one of the plurality of blocks 12 that is stacked thereon. For instance, it is foreseen that the bottom surface 26 of one or more of the plurality of blocks 12 may include an extension sized and shaped to extend into and nest at least partially within the cavity 34 when the one or more of the plurality of blocks 12 is stacked thereon without deviating from the scope of the present inventive concept. In this manner, the plurality of blocks 12 may be securely stacked on each other and advantageously resist undesired lateral displacement therebetween.

The top surface 24 also includes a shelf 36 extending along a rear-most portion of the top surface 24. The shelf 36 may be utilized for, among other things, further anchoring the adjacent one of the plurality of blocks 12 that is stacked thereon. For instance, the bottom surface 26 of one or more of the plurality of blocks 12 includes at least one ridge 38, which is sized and shaped to extend into and nest at least partially on the shelf 36 when the one or more of the plurality of blocks 12 is stacked thereon. In this manner, the plurality of blocks 12 may be securely stacked on each other and advantageously resist undesired lateral displacement therebetween. It is foreseen that the plurality of blocks 12 may be designed with or without (i) the shelf 36 and the at least one ridge 38, and/or (ii) the cavity 34 and the extension without deviating from the scope of the present inventive concept.

In the exemplary embodiment, the top surface 24 is planar, 48 inches wide and 24 inches long with the cavity 34 centered between the side surfaces 28 and spaced 11.29 inches from the front surface 20, but it is foreseen that the top surface 24 may be otherwise sized and/or shaped without deviating from the scope of the present inventive concept. In the exemplary embodiment, the shelf 36 extends 2 inches perpendicularly into the top surface 24, and 2 inches parallel to the top surface 24, but it is foreseen that the shelf 36 may be otherwise sized and/or shaped without deviating from the scope of the present inventive concept. In the exemplary embodiment, the at least one ridge 38 is two identically sized and shaped ridges, each extending 2 inches perpendicularly from the bottom surface 26, and 3 inches parallel to the bottom surface 26, but it is foreseen that the at least one ridge 38 may only include a single ridge or more than two ridges, and/or be otherwise sized and/or shaped without deviating from the scope of the present inventive concept The bottom surface 26, in the exemplary embodiment, is planar, 48 inches wide and 24 inches long, but it is foreseen that the bottom surface 26 may be otherwise sized and/or shaped without deviating from the scope of the present inventive concept.

The diverging portion 32 of each of the side surfaces 28 advantageously allows adjacent ones of each of the plurality of blocks 12 to be oriented at a plurality of angles relative to each other, while the front surface 20 of each of the adjacent ones forms a continuous surface without any gap or at least a minimalized gap between the front surfaces 20 of the adjacent ones. In this manner, the plurality of blocks 12 may be stacked next to each other to advantageously form a non-linear or curved retaining wall as well as a linear or straight wall. In the exemplary embodiment, the side surfaces 28 have a height of 18 inches and a length of 14 inches with the parallel portions 30 extending 3 inches from the front surface 20, but it is foreseen that the side surfaces 28 may be otherwise sized without deviating from the scope of the present inventive concept.

The top surface 24 also includes a shelf 36 extending along a rear-most portion of the top surface 24. The shelf 36 may be utilized for, among other things, further anchoring the adjacent one of the plurality of blocks 12 that is stacked thereon. For instance, the bottom surface 26 of one or more of the plurality of blocks 12 includes at least one ridge 38, which is sized and shaped to extend into and nest at least partially on the shelf 36 when the one or more of the plurality of blocks 12 is stacked thereon. In this manner, the plurality of blocks 12 may be securely stacked on each other and advantageously resist undesired lateral displacement therebetween. It is foreseen that the plurality of blocks 12 may be designed with or without (i) the shelf 36 and the at least one ridge 38, and/or (ii) the cavity 34 and the extension without deviating from the scope of the present inventive concept.

The rear surface 22 includes at least one receiver or channel 40 extending into the rear surface 22 and partially through each respective one of the plurality of blocks 12. In the exemplary embodiment, the at least one channel includes two channels, but it is foreseen that the rear surface 22 can include only a single channel or more than two channels without deviating from the scope of the present inventive concept. The at least one channel 40 includes an entrance 42 on the rear surface 22 with an abutment portion 44 of the rear surface 22 entirely surrounding the entrance 42.

In the exemplary embodiment, the rear surface 22 is planar, with a width of 36 inches and a height of 16 inches, which does not include any portion of the shelf 36 or the at least one ridge 38, but it is foreseen that the rear surface 22 may be otherwise sized and/or shaped without deviating from the scope of the present inventive concept. In the exemplary embodiment, a center of the entrance 42 of the at least one channel 40 is spaced 9 inches from the bottom surface 26 without including the at least one ridge 38, and 6 inches from one of the side surfaces 28, but it is foreseen that the entrance 42 of the at least one channel 40 may be otherwise positioned on the rear surface 22 without deviating from the scope of the present inventive concept. In the exemplary embodiment, the at least one channel 40 extends 5 inches into each respective one of the plurality of blocks 12, but it is foreseen that the at least one channel 40 may extend further or may not extend as far without deviating from the scope of the present inventive concept.

Each of the plurality of spacer plates 14 include a plate 60 with an interior-facing surface 62 and an exterior-facing surface 64 extending parallel to the inner surface 62. The surfaces 62, 64 are spaced from each other by a perimeter edge 66. At least one arm 68 extends from the interior-facing surface 62 of each of the plurality of spacer plates 14, and is sized and shaped to be received by the at least one channel 40. In the exemplary embodiment, the at least one arm 68 includes two arms, but it is foreseen that the interior-facing surface 62 can include only a single arm or more than two arms without deviating from the scope of the present inventive concept. The at least one arm 68 includes a friction-enhancing element 70 and a backstop 72 positioned along the at least one arm 68 and spaced from each other along the at least one arm 68. The plate 60 includes a plurality of apertures 74 extending therethrough, which are advantageously operable to allow fluid and/or other small particles to pass through the plate 60.

In the exemplary embodiment, each of the plurality of spacer plates 14 are rectangular with a width of 48 inches and a height of 18 inches, but it is foreseen that the plurality of spacer plates 14 may be otherwise sized and/or shaped without deviating from the scope of the present inventive concept. In the exemplary embodiment, the at least one arm 68 is positioned on the interior-facing surface 62 such that a center of the at least one arm 68 is centered between top and bottom portions of the edge 66 at 9 inches and spaced 12 inches from a nearest side portion of the edge 66, but it is foreseen that the at least one arm 68 may be otherwise positioned on the interior-facing surface 62 without deviating from the scope of the present inventive concept. In the exemplary embodiment, the at least one arm 68 extends 17 inches from the interior-facing surface 62 with the friction-enhancing element 70 spaced 12 inches from the interior-facing surface 62 and the backstop 72 spaced 4 inches from the friction-enhancing element 70, but it is foreseen that the at least one arm 68 may extend further, may not extend as far, and/or the friction-enhancing element 70 and/or the backstop 72 may be otherwise positioned on the at least one arm 68 without deviating from the scope of the present inventive concept.

The system 10 is manufactured by separately forming the plate 60 and the at least one arm 68 via one or more plastic resins, e.g., via injection molding. After formation, the at least one arm 68 is secured to the plate 60, e.g., via an arm receiver in the plate 60, via a friction-fit engagement, an adhesive, and/or the like to form one of the plurality of spacer plates 14. After assembly of the plurality of spacer plates 14, each of the plurality of blocks 12 are formed via a casting material, e.g., concrete, using a casting mold. After each one of the plurality of blocks 12 have been poured, but prior to curing, one of the plurality of spacer plates 14 is inserted into the one of the plurality of blocks 12 until the backstop 72 abuts the abutment portion 44. In this manner, the channel 40 is formed by the at least one arm 68. When each one of the plurality of blocks 12 are completely cured, the one of the plurality of spacer plates 14 are secured therein by the friction-enhancing element 70, i.e., via a friction-fit engagement, and the assembly is ready for use. It is foreseen that the plurality of spacer plates 14 may be made via a single mold, e.g., via injection molding, without deviating from the scope of the present embodiment. It is foreseen that each of the plurality of blocks 12 may be formed around each of the plurality of spacer plates 14, with each of the plurality of spacers positioned in a casting mold prior to introduction of a casting material, without deviating from the scope of the present embodiment.

The system 10 is used by positioning one of the plurality of blocks 12 with one of the plurality of spacer plates 14 on a surface 80, e.g., a ground surface 58. In most applications, multiple ones of the plurality of blocks 12 with one of the plurality of spacer plates 14 will be positioned next to each other to form a first horizontal row. Next, gravel 82 is added to completely fill a space 84 formed between the interior-facing surface 62 of the plate 60 of the plurality of spacer plates 14 and the rear surface 22 of the plurality of blocks 12. It is foreseen that, depending on the application and how adjacent ones of the plurality of blocks 12 are oriented relative to each other, the gravel 82 will extend into and completely fill a gap formed between the adjacent ones of the plurality of blocks 12. Next, soil and/or other material to-be retained by the system 10 of the present inventive concept is added to completely fill any gap between the exterior-facing surface 64 of the plate 60 of the plurality of spacer plates 14. After filling, additional ones of the plurality of blocks 12 are positioned on one of the plurality of blocks 12 in the first horizontal row, thereby forming a second horizontal row, with the process repeated to form as many horizontal rows as required by the application. Prior to forming additional horizontal rows, the space 84 and any gaps are filled as previously discussed. In this manner, the system 10 does not present any dangerous conditions during construction of the system 10. Further, given the space 84 defined by each of the plurality of spacer plates 14 and each of the plurality of blocks 12 has a predetermined size, a user of the system 10 is advantageously able to calculate volume and better forecast an amount of the gravel 82 required for each application. It is foreseen, however, that the space 84 may be sized smaller or larger, thereby altering the volume, without deviating from the scope of the present inventive concept. In this manner, the system 10 prevents waste of materials while ensuring an ideal amount of the gravel 82 is utilized for proper drainage of water from the soil and/or other material.

Turning to FIGS. 6-11, a retaining wall system 61 according to another embodiment of the present inventive concept is illustrated. The system 61 includes a plurality of modular blocks 63. Each of the plurality of modular blocks 63 includes a top surface 65 and a bottom surface 67. In an exemplary embodiment, the top surface 65 and the bottom surface 67 are generally planar and parallel to each other. Each of the plurality of modular blocks 63 also includes a front wall 50 and a pair of exterior sidewalls 52 extending from the front wall 50. The front wall 50 defines a face surface 75 having a contoured surface. In the exemplary embodiment, the face surface 75 is smooth with a uniform texture. It is foreseen, however, that the face surface 75 may have a non-flat surface and/or a non-uniform texture without deviating from the scope of the present inventive concept. For instance, the face surface 75 may be formed to have a natural-stone finish, a brick-wall finish, or other aesthetically-pleasing finish without deviating from the scope of the present inventive concept. In the exemplary embodiment, the face surface 75 has a width of 48 inches and a height of 18 inches, but it is foreseen that the face surface 75 may be otherwise sized and/or shaped without deviating from the scope of the present inventive concept.

Figure 7:
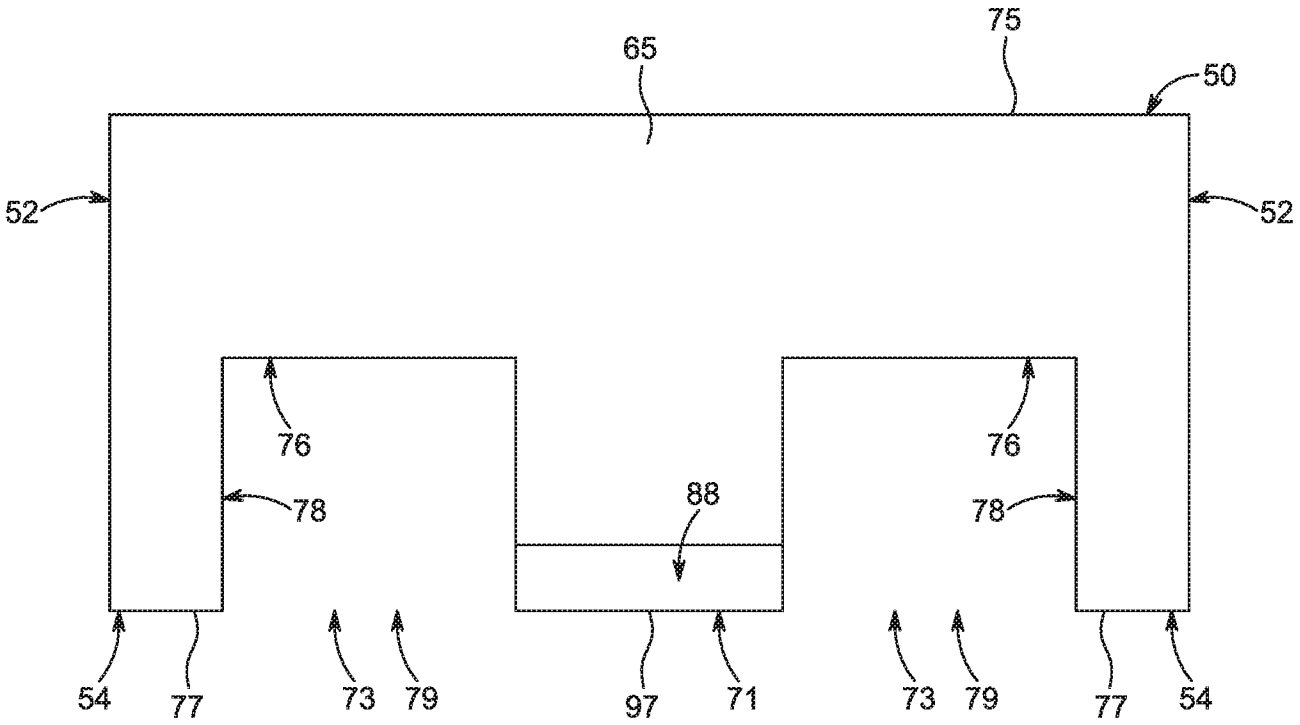
FIG. 7 is a top plan view of a modular block of the system of FIG. 6.
Figure 8:
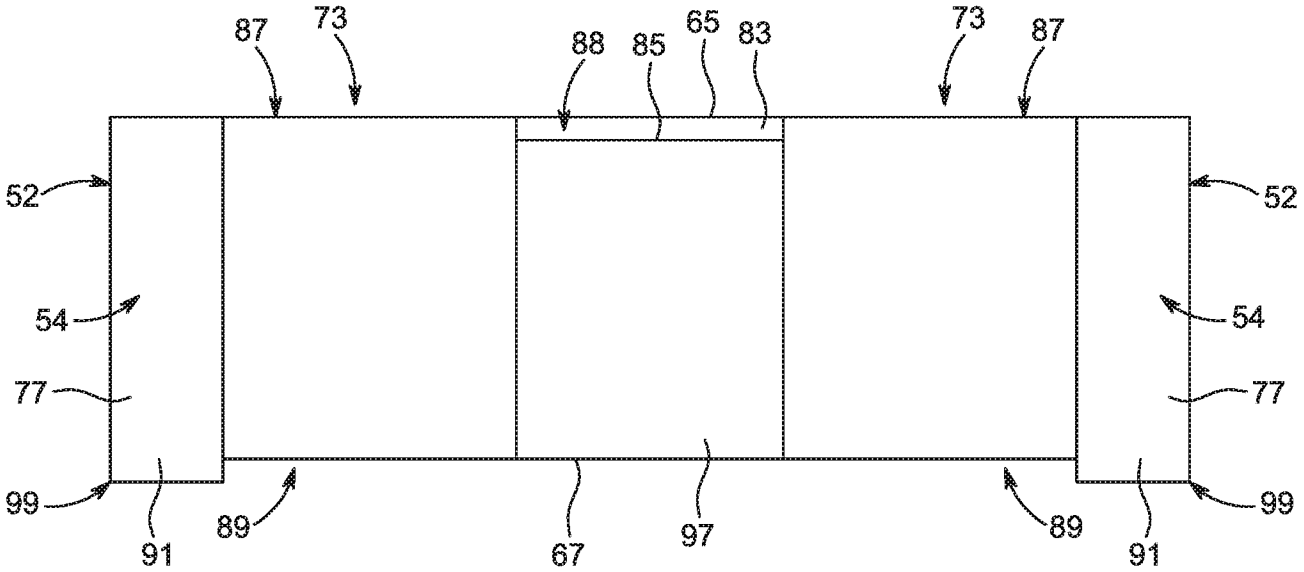
FIG. 8 is rear view of the modular block of Fig.

Each of the plurality of modular blocks 63 further includes an exterior rear wall 54, shown in FIGS. 7-8, extending partially between the pair of exterior sidewalls 52. Each of the plurality of modular blocks 63 also includes an interior rear wall 76 extending partially between the pair of exterior sidewalls 52 and spaced between the front wall 50 and the exterior rear wall 54. The exterior rear wall 54 defines a pair of exterior rear wall surfaces 77 extending from the top surface 65 to the bottom surface 67. In the exemplary embodiment, each of the pair of exterior rear wall surfaces 77 is planar and has a width of 11 inches and a height of 18 inches, but it is foreseen that each of the pair of exterior rear wall surface 77 may be otherwise sized and/or shaped without deviating from the scope of the present inventive concept. In an embodiment, the front wall 50 has a front wall length (Length_FW) and each of the pair of exterior side walls 52 has an exterior side wall length (Length_ESW) and the ratio of Length_FW:Length_ESW is at least 1.5:1.

A pair of interior sidewalls 78 extends between the exterior rear wall 54 and the interior rear wall 76. A divider 71 extends from the interior rear wall 76 and extends between the pair of interior sidewalls 78. The divider 71 defines a rear divider surface 97 extending from a portion below the top surface 65 to the bottom surface 67. In the exemplary embodiment, the rear divider surface 97 is planar with a width of 10 inches and a height of 17 inches, but it is foreseen that the rear divider surface 97 may be otherwise sized and/or shaped without deviating from the scope of the present inventive concept. The pair of interior sidewalls 78 and the divider 71 define a pair of channels 73. Each of the pair of channels 73 includes a top 87, bottom 89, and rear opening 79. It is foreseen that each of the plurality of modular blocks 63 can have one channel or more than two channels and that each channel can have a different shape and/or size from each other without deviating from the scope of the present inventive concept.

Each of the plurality of modular blocks 63 also includes a pair of protrusions 99 extending from the bottom surface 67 and parallel to the exterior rear wall 54. Each protrusion of the pair of protrusions 99 defines an extension surface 91 of the pair of exterior rear wall surfaces 77, a protrusion bottom surface 93, and a ledge surface 95. Each of the plurality of modular blocks 63 also includes an indentation 88 extending into the rear divider surface 97 and defining a first abutment surface 83 and a second abutment surface 85. The indentation 88 and one of the pair of protrusions 99 are sized and shaped to engage each other.

Each of the plurality of modular blocks 63 are operable to be stacked on top of each other by way of the indentation 88 receiving one of the pair of protrusions 99 of another modular block 63. When the indentation 88 of one modular block 63 receives one of the pair of protrusions 99 of another modular block 63, the ledge surface 95 abuts the first abutment surface 83 and a portion of the protrusion bottom surface 93 abuts the second abutment surface 85. It is foreseen that the entire protrusion bottom surface 93 can abut the second abutment surface 85 without deviating from the scope of the present inventive concept.

In the exemplary embodiment, each of the pair of protrusions 99 extends 1 inch from the bottom surface 67, has a width equal to a width of the each of the pair of exterior rear wall surfaces 77, and a length of 4 inches. It is foreseen that each of the pair of protrusions 99 can extend any distance from the bottom surface, can have a width less than or greater than the width of each of the pair of exterior rear wall surfaces 77, and can have a smaller or larger length without deviating from the scope of the present inventive concept. It is also foreseen that each of the pair of protrusions 99 can have one continuous, smooth surface, such as a curved surface, without deviating from the scope of the present inventive concept.

In the exemplary embodiment, the indentation 88 extends 1 inch into the top surface 64, has a width equal to the width of the rear divider surface 97, and a length of 3 inches. It is foreseen that the indentation 88 can extend any distance into the top surface 65, can have a width less than or greater than the width of the rear divider surface 97, and can have a smaller or larger length without deviating from the scope of the present inventive concept. It is also foreseen that the indentation 88 can have one continuous, smooth surface, such as a curved surface, without deviating from the scope of the present inventive concept.

Figure 9:
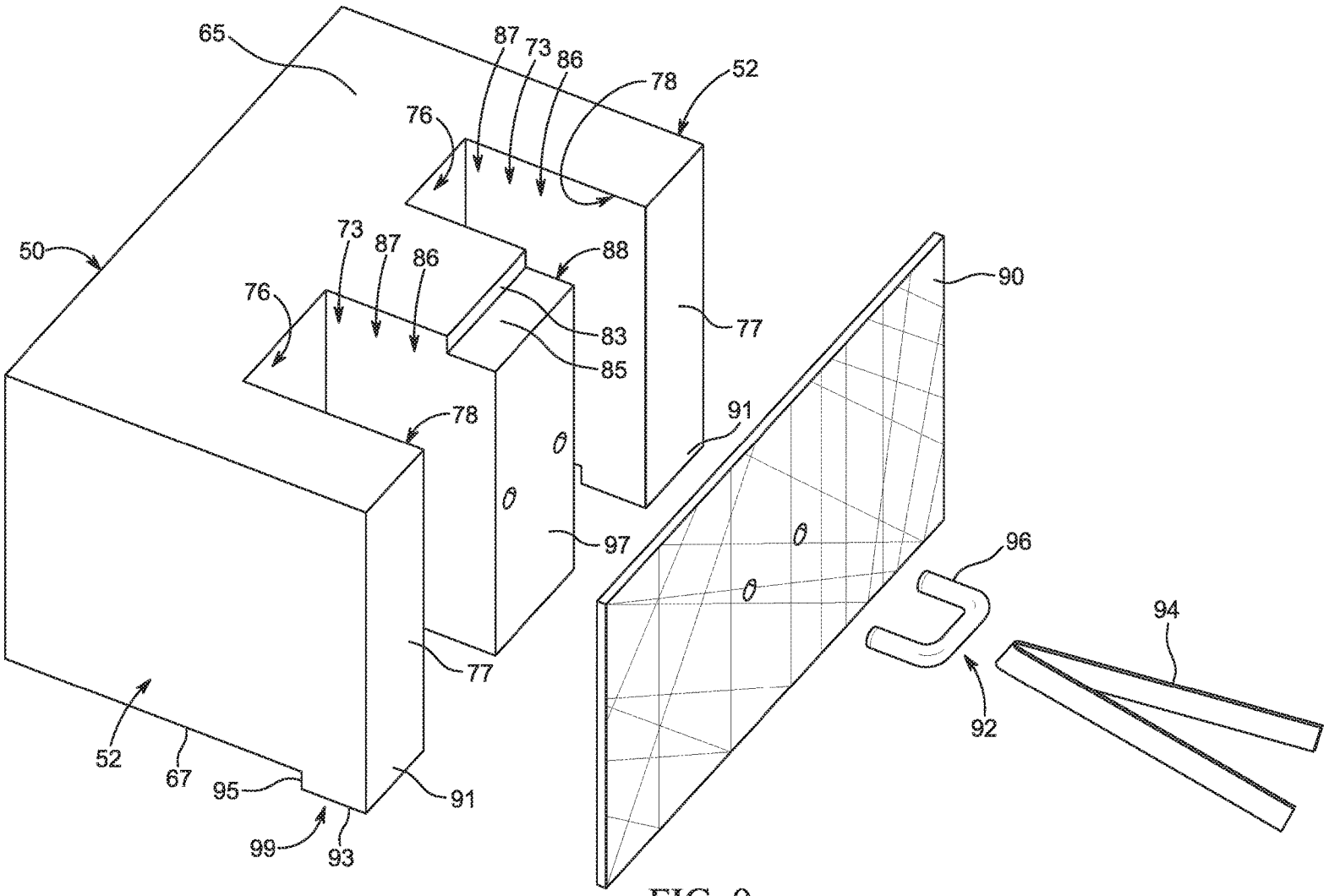
FIG. 9 is an exploded, perspective view of the modular block and a strap of the system of Fig., with the modular block, a fabric, an anchor, and a strap unassembled and prior to use.
Figure 10:
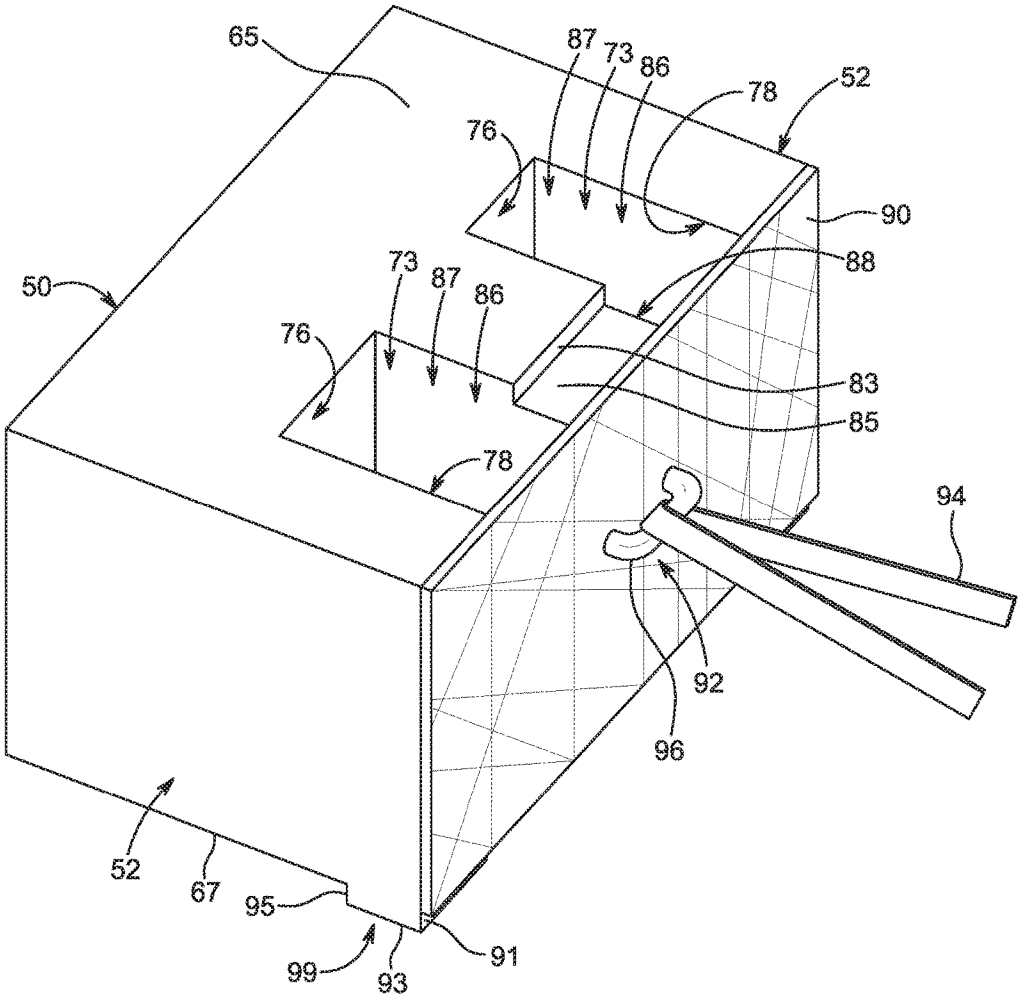
FIG. 10 is a perspective view of the modular block, the fabric, and the strap of FIG. 9, with the modular block, the fabric, the anchor, and the strap assembled prior to use.
Figure 11:
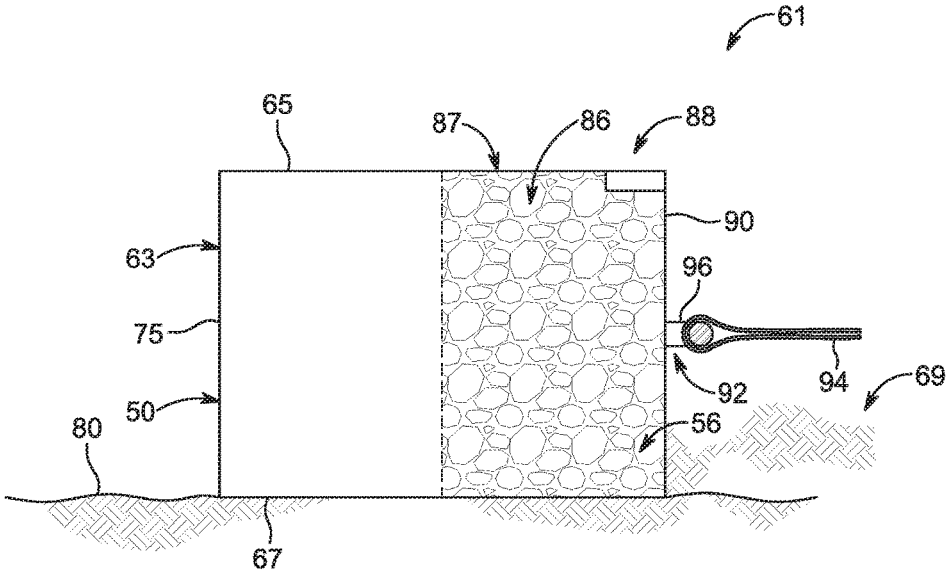
FIG. 11 is a left side elevation, cross-section view of the modular block, the fabric, the anchor, and the strap installed on a ground surface, after filling the block and the ground surface to the strap. Cite to a figure.

As shown in FIGS. 9-10, a filter 90 extends across one of the plurality of modular blocks 63. The filter 90 extends across the pair of exterior rear wall surfaces 77, the rear opening 79 of each of the pair of channels 73, and the rear divider surface 97 and from the top surface 65 to the bottom surface 67 of one of the plurality of modular blocks 63. The filter 90 does not extend over the extension surface 91 of each of the pair of protrusions 99, however, it is foreseen that the filter 90 can extend over the extension surface 91 of each of the pair of protrusions 99 without deviating from the scope of the present inventive concept. In the exemplary embodiment, the filter 90 has a width of 44 inches and a height of 18 inches, but it is foreseen that the filter 90 may be otherwise sized and/or shaped without deviating from the scope of the present inventive concept. The filter 90 is operable to prevent a filler material 56 in the pair of channels 73 from moving from the pair of channels 73. The filter 90 also permits liquid to pass through the pair of channels 73 for proper drainage of water from the filler material 56 by providing a path of least resistance for the water to flow through. Because the filter 90 is more permeable and porous than one of the plurality of modular blocks 63, water is directed through the filter 90. In the exemplary embodiment, the filler material 56 is gravel 82, although it is foreseen that the filler material 56 may be any material such as sand, dirt, pebbles, rocks, or the like, without deviating from the scope of the present inventive concept.

An anchor, 92, in the form of a hook 96, extends into one of the plurality of modular blocks 63. It is foreseen that the anchor 92 may be any other type of anchor 92 such as, but not limited to, a ring, an open hook, or a solid mass with an opening, without deviating from the scope of the present inventive concept. The anchor 92 extends into the rear divider surface 97 of one of the plurality of modular blocks 63. It is foreseen that one of the plurality of modular blocks 63 can have more than one anchor 92 or no anchor 92 without deviating from the scope of the present inventive concept.

A strap 94 is secured to one of the plurality of modular blocks 63 and is operable to hold one of the plurality of modular blocks 63 in a soil mass 69. In the exemplary embodiment, the strap 94 is secured to one of the plurality of modular blocks 63 via the hook 96 and wraps or ties around the hook 96. It is foreseen that the strap 94 may be secured to one of the plurality of modular blocks 63 by any other means, such as an adhesive, without deviating from the scope of the present inventive concept. The strap 94 may be made from, but not limited to, webbing sold under the Trade Mark PARAWEB, para-aramid synthetic straps sold under the Trade Mark KEVLAR, polyester, geosythentics, steel, or the like without deviating from the scope of the present inventive concept. The length of the strap 94 is in the range of 4 meters to 10 meters, but it is foreseen that the strap 94 can be any length without deviating from the scope of the present inventive concept. Furthermore, it is foreseen that one of the plurality of modular blocks 63 can have more than one strap 94 or no strap 94 without deviating from the scope of the present inventive concept.

The system 61 is manufactured by forming the plurality of modular blocks 63 via a casting material, e.g., concrete, using a casting mold. After one of the plurality of modular blocks 63 has been poured, but prior to curing, the anchor 92 is inserted into one of the plurality of modular blocks 63 until a portion of the anchor 92 is spaced away from the rear divider surface 97. It is foreseen that one of the plurality of modular blocks 63 may be formed around the anchor 92, with the anchor 92 positioned in the casting mold prior to introduction of the casting material, without deviating from the scope of the present embodiment.

After each one of the plurality of modular blocks 63 are completely cured, the filter 90 is secured to one of the plurality of modular blocks 63, with the filter 90 extending across the pair of exterior rear wall surfaces 77, the rear opening 79 of each of the pair of channels 73, and the rear divider surface 97 and from the top surface 65 to the bottom surface 67 of one of the plurality of modular blocks 63. The filter 90 can be secured to one of the plurality of modular blocks 63 via a heavy duty adhesive, e.g. a construction adhesive, or the like. After the filter 90 is secured to one of the plurality of modular blocks 63, the strap 94 can be secured to anchor 92 via tying or wrapping the strap 94 to the anchor 92. It is foreseen that the strap 94 can be secured to the anchor 92 before or during installation of the system 61, or any other time.

The system 61 is used by positioning one of the plurality of modular blocks 63 on the surface 80, e.g. the ground 58. In most applications, multiple ones of the plurality of modular blocks 63 will be positioned next to each other to form a first horizontal row. Next, the filler material 56 consisting of gravel 82 is added to completely fill a volume 86 defined by the pair of channels 73, the filter 90, the ground 58, and the top 87 of each of the pair of channels 73. It is foreseen that, depending on the application and how adjacent ones of the plurality of modular blocks 63 are oriented relative to each other, the gravel 82 will extend into and completely fill a gap formed between the adjacent ones of the plurality of modular blocks 63. Next, soil and/or other material is added behind each of the plurality of modular blocks 63 until the soil reaches or contacts the anchor 92 of each of the plurality of modular blocks 63. The strap 94 is laid on top of the soil and stretch to its length. Alternatively, if the strap 94 has not be secured to the anchor 92, the strap 94 will first be secured to the anchor 92, then stretched to its length and positioned on top of the soil. Next, soil is added to the top of each of the plurality of modular blocks 63. After filling each of the plurality of modular blocks 63 with gravel 82 and filling soil behind each of the plurality of modular blocks 63, additional ones of the plurality of modular blocks 63 are positioned on one of the plurality of modular blocks 63 in the first horizontal row via the indentation 88 of one of the plurality of modular blocks 63 receiving the protrusion 99 of another modular block 63, thereby forming a second horizontal row, with the process repeated to form as many horizontal rows as required by the application. Prior to forming additional horizontal rows, the volume 86 and any gaps are filled as previously discussed. In this manner, the system 61 does not present any dangerous conditions during construction of the system 61. Further, given the volume 86 defined by each of the pair of channels 73 and the filter 90 has a predetermined size, a user of the system 61 is advantageously able to calculate volume and better forecast an amount of the gravel 82 required for each application. Furthermore, the user of the system 61 is better able to prevent waste of materials as the gravel 82 is held in the pair of channels 73 and the filter 90, and not being lost to the environment. It is foreseen, however, that the volume 86 may be sized smaller or larger, thereby altering the volume, without deviating from the scope of the present inventive concept. In this manner, the system 61 prevents waste of materials while ensuring an ideal amount of the gravel 82 is utilized for proper drainage of water from the soil and/or other material.

Having now described the features, discoveries and principles of the general inventive concept, the manner in which the general inventive concept is constructed and used, the characteristics of the construction, and advantageous, new and useful results obtained; the new and useful structures, devices, tools, elements, arrangements, parts and combinations, are set forth in the appended claims.

It is also to be understood that the following claims are intended to cover all of the generic and specific features of the general inventive concept herein described, and all statements of the scope of the general inventive concept which, as a matter of language, might be said to fall there between.

What is claimed is:

1. A modular block comprising:

a front wall defining a face surface;

a pair of exterior sidewalls extending from the front wall;

an exterior rear wall extending partially between the pair of exterior sidewalls;

an interior rear wall extending partially between the pair of exterior sidewalls and spaced between the front wall and the exterior rear wall;

a top surface connecting the front wall and the interior rear wall;

a pair of interior sidewalls extending between the exterior rear wall and the interior rear wall; and a divider (i) extending from the interior rear wall and having a rear divider surface opposite the front wall, (ii) extending between the pair of interior sidewalls, and (iii) partially defining a plurality of channels, wherein the exterior rear wall and the rear divider surface extend along a plane and, a protrusion extending from an edge of the exterior rear wall defining a first abutment surface, and an indentation extending into an edge of the rear divider surface that is opposite to the edge of the exterior rear wall defining a second abutment surface.

2. The modular block of claim 1, wherein, the pair of interior sidewalls and the interior rear wall define at least one channel.

3. The modular block of claim 1, wherein, each of the plurality of channels include top, bottom, and rear openings.

4. The modular block of claim 1, further comprising:

an anchor extending into the divider.

5. The modular block of claim 4, further comprising:

a strap extending from the anchor operable to hold the modular block in a soil mass.

6. The modular block of claim 1, further comprising:

a filter (i) extending at least partially across the exterior rear wall, and (ii) operable to permit liquid to pass therethrough.

7. The modular block of claim 1, wherein, the face surface is a contoured surface.

8. The modular block of claim 1, wherein, the indentation and the protrusion are correspondingly sized and shaped.

9. The modular block of claim 8, wherein, the indentation is configured to receive at least a portion of another protrusion of another modular block when the another modular block is stacked on the modular block so that the second abutment surface at least partially receives another first abutment surface of the another modular block.

10. The modular block of claim 1, wherein, the front wall has a front wall length (Length_FW) and each of the pair of exterior side walls has an exterior side wall length (Length_ESW), and wherein a ratio Length_FW:Length_ESW is at least 1.5:1.

11. The modular block of claim 10, wherein,

Length_FW is in a range of 40-56 inches and Length_ESW is in a range of 20-28 inches.

12. A method of manufacturing a modular block, the method comprising the steps of:

forming a block including (i) a front wall defining a face surface, (ii) a pair of exterior sidewalls extending from the front wall, (iii) an exterior rear wall extending partially between the pair of exterior sidewalls, (iv) an interior rear wall extending partially between the pair of exterior sidewalls and spaced between the front wall and the exterior rear wall, (v) a top surface connecting the front wall and the interior rear wall; (vi) a pair of interior sidewalls extending between the exterior rear wall and the interior rear wall, and (vii) a divider extending from the interior rear wall and having a rear divider surface opposite the front wall, extending between the pair of interior sidewalls, and partially defining a plurality of channels, wherein the exterior rear wall and the rear divider surface extend along a plane and forming a protrusion extending from an edge of the exterior rear wall; and forming an indentation extending into an edge of the rear divider surface that is opposite to the edge of the exterior rear wall, wherein the protrusion and the indentation are correspondingly sized and shaped.

13. The method of claim 12, further comprising the steps of:

securing a filter to the exterior rear wall, the filter operable to at least partially enclose the plurality of channels; and securing an anchor within the divider so that a hook of the anchor is exposed.

14. A method of forming a retaining wall using a plurality of modular blocks, the method comprising the steps of:

forming a first portion by placing a first set of modular blocks along a first row, each of the modular blocks having (i) a front wall defining a face surface, (ii) a pair of exterior sidewalls extending from the front wall, (iii) an exterior rear wall extending partially between the pair of exterior sidewalls, (iv) an interior rear wall extending partially between the pair of exterior sidewalls and spaced between the front wall and the exterior rear wall, (v) a top surface connecting the front wall and the interior rear wall, (vi) a pair of interior sidewalls extending between the exterior rear wall and the interior rear wall defining at least one channel and (vii) a divider (i) extending from the interior rear wall and having a rear divider surface opposite the front wall, (ii) extending between the pair of interior sidewalls, and (iii) partially defining a plurality of channels, wherein the exterior rear wall and the rear divider surface extend along a plane;

filling a first space defined by each channel of the first set of the modular blocks;

forming a second portion by placing a second set of the modular blocks along a second row; and filling a second space defined by each channel of the second set of the modular blocks wherein each of the plurality of modular blocks further includes an indentation extending into an edge of the rear divider surface and a protrusion extending from an edge of the exterior rear wall that is opposite to the edge of the rear divider surface and each of the plurality of modular blocks are operable to be stacked on top of each other by way of the indentation receiving the protrusion.

15. The method of claim 14, wherein, each of the first space and the second space has a predetermined volume.

* * * * *